US006790095B2

(12) United States Patent
Liu

(10) Patent No.: US 6,790,095 B2
(45) Date of Patent: Sep. 14, 2004

(54) ANALOG AND DIGITAL AUDIO CONNECTOR

(76) Inventor: Richard Liu, 5F-1, No. 492-4, Wan Shou Rd., Guei-shan Hsiang, Taoyuan Hsien (TW)

( * ) Notice: Subject to any disclaimer, the term of this patent is extended or adjusted under 35 U.S.C. 154(b) by 0 days.

(21) Appl. No.: 10/435,019

(22) Filed: May 12, 2003

(65) Prior Publication Data

US 2004/0029449 A1 Feb. 12, 2004

Related U.S. Application Data

(63) Continuation-in-part of application No. 10/214,322, filed on Aug. 8, 2002.

(51) Int. Cl.[7] ..... H01R 24/04
(52) U.S. Cl. ..... 439/668; 439/620
(58) Field of Search ..... 385/88–94; 439/668, 439/669, 188, 108, 620

(56) References Cited

U.S. PATENT DOCUMENTS 6,000,970 A * 12/1999 Wu ..... 439/669
6,056,602 A * 5/2000 Wu ..... 439/668
6,109,797 A * 8/2000 Nagura et al. ..... 385/88

* cited by examiner

*Primary Examiner*—Ross Gushi
(74) *Attorney, Agent, or Firm*—Jacobson Holman PLLC

(57) ABSTRACT

An analog and digital audio connector includes a plastic housing, an analog and/or a digital receiver. The plastic housing is provided with an insertion opening at a front end thereof. The analog terminal unit is placed in the plastic housing and located in the insertion opening. The digital receiver is disposed at a rear end of the insertion opening of the plastic housing. Analog signals are transmitted when inserting an analog signal plug into the insertion opening of the plastic housing. Digital signals using optical signals are transmitted when inserting a digital signal plug. The same plastic housing is able to function as an audio connector socket for transmitting analog or digital signals.

2 Claims, 5 Drawing Sheets

ANALOG AND DIGITAL AUDIO CONNECTOR

This is a CIP of U.S. Pat Ser. No. 10/214,322 filed Aug. 8, 2002.

BACKGROUND OF THE INVENTION (a) Field of the Invention

The invention relates to an analog and digital audio connector, and more particularly, to a socket structure capable of being selectively assembled as an analog and/or digital signal connector, thereby adapting to sound peripherals and equipment that employ analog or digital signals.

(b) Description of the Prior Art

Video and audio signals are generally required when using multimedia applications in a common computer, and hence it is necessary to install a video or audio connector on a motherboard or an interface card of the computer.

Conventional signal transmissions are often completed using analog methods, and as a result, audio connectors are frequently designed in analog standards. According to a prior audio connector, a plastic housing thereof is provided with an insertion opening and a plurality of terminals, and the terminals are located in the insertion opening. When an audio plug is inserted into the insertion opening at the plastic housing, the terminals come into direct contact with the audio plug, thereby transmitting analog signals.

In addition, industrialists have developed digital standards using light to transmit signals; this digital signal transmission means is now extensively applied in sound equipment.

However, input or output connectors provided on motherboards and sound-effect interface cards of existing computers are still mostly in analog standards. It is then probable that up-to-date sound equipment cannot be used when being connected to these computers, and thus causing disturbances for multimedia computer users.

Furthermore, if connectors provided on motherboards or sound-effect interface cards of existing computers are directly replaced with digital connectors, the issue of inapplicability of sound equipment that use analog signal outputs is nevertheless left unsolved, and thus creating another kind of disturbances for computer users.

Suppose two standards namely digital connectors and analog connectors are instantaneously disposed on a motherboard or a sound-effect interface card of a computer, that is, two connectors serving same purposes are installed on the motherboard—more spaces of the motherboard or the sound-effect interface card of the computer are occupied. Also, inputs and outputs are independently disposed, meaning that four connectors are needed for simultaneously installing connectors using analog and digital standards. Consequently, excessive areas on the motherboard are taken up and an object of miniaturization is not obtained. Above all, production expenses are increased as well as being uneconomical.

In the view of the aforesaid shortcomings caused by the connectors for transmitting audio signals being classified into two different standards, namely analog and digital, it is a vital task of the invention to provide an analog and digital connector. In accordance with the invention, a characteristic of similarities in specifications and sizes of existing analog signal plugs and digital signal round plugs are utilized. The invention comprises a plastic housing and an analog terminal unit and/or a digital receiver. Wherein, the plastic housing is provided with an insertion opening at a front end thereof, the analog terminal unit is placed in the plastics housing and situated in the insertion opening, and the digital receiver is disposed a rear end of the insertion opening at the plastic housing. According to the aforesaid structure, a socket structure is formed using a same plastic housing as a main body thereof for selectively assembling into an analog and/or a digital connector, thereby lowering production cost for industrialists and facilitating users to directly utilize sound peripherals and equipment that employ analog or digital signals.

SUMMARY OF THE INVENTION

Therefore, the primary object of the invention is to provide an audio connector, wherein a plastic housing thereof is disposed with an analog terminal unit and a digital receiver, thereby plugging into and putting sound peripherals and equipment that employ analog or digital signal connectors to use. connectors to use.

The secondary object of the invention is to provide an analog and digital audio connector, wherein a plastic housing thereof may selectively be disposed with an analog terminal unit and/or a digital receiver, thereby simplifying manufacturing and production cost of the plastic housing while also offering more choices for the industrialists.

DETAILED DESCRIPTION OF THE PREFERRED EMBODIMENTS

Figure 1:
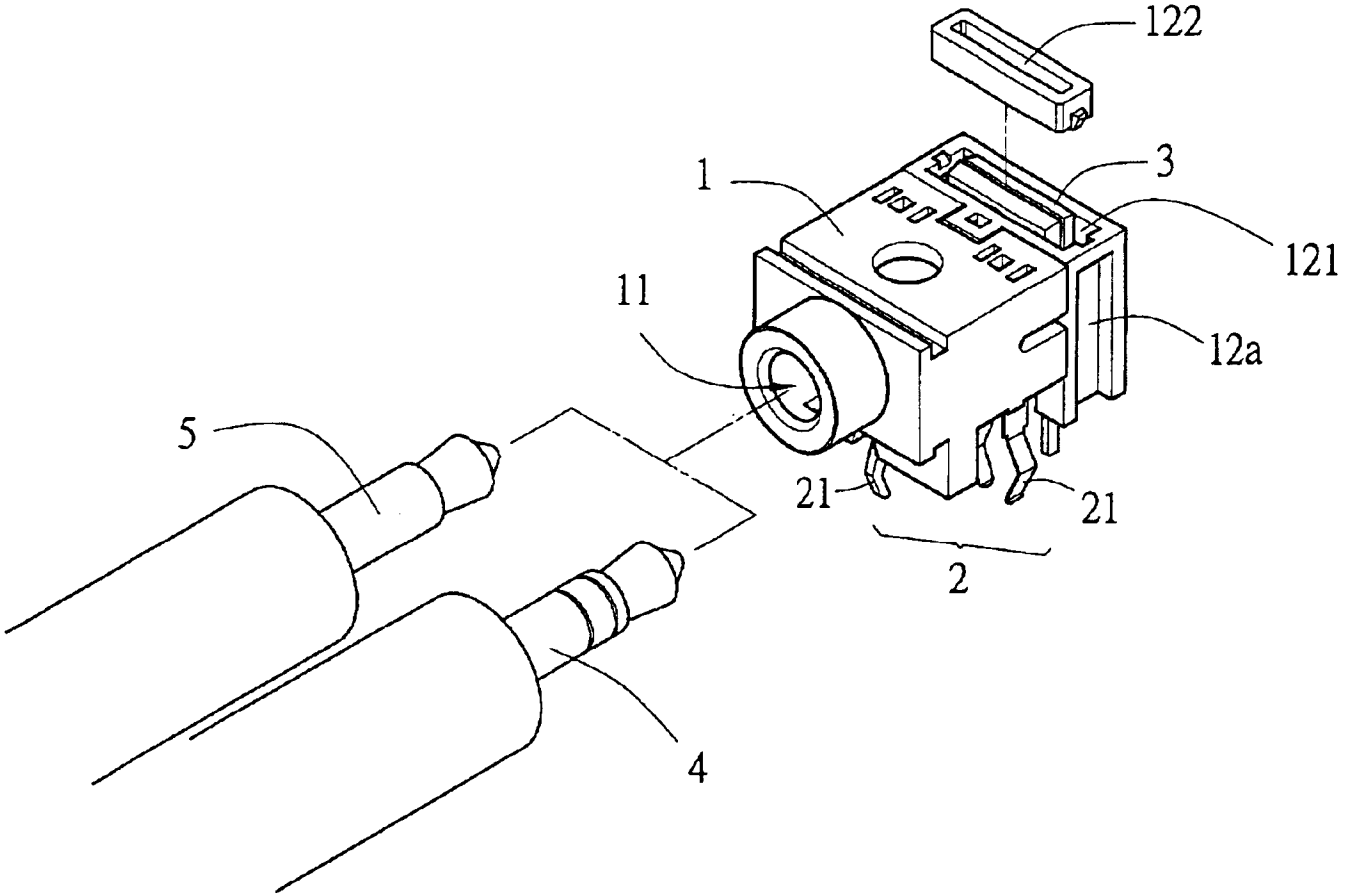
FIG. 1 shows an elevational view of the analog and digital connector according to the invention.
Figure 2:
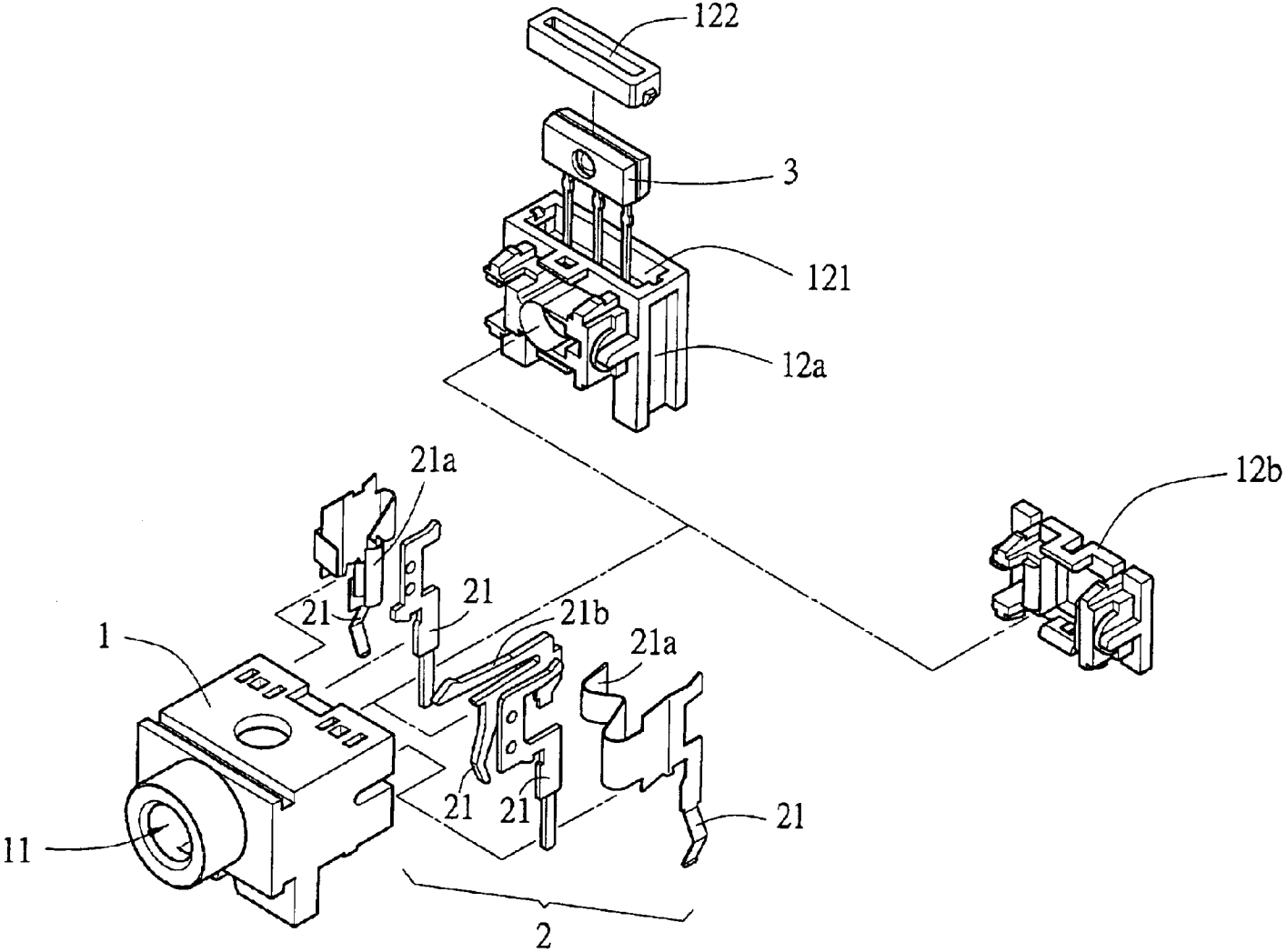
FIG. 2 shows an exploded elevational view according to the invention.

To better understand the invention, descriptions shall be given with the accompanying drawings hereunder.

Referring to FIGS. 1 to 4, the invention comprises a plastic housing 1, an analog terminal unit 2, and a digital receiver 3. Wherein:

- the plastic housing 1 is provided with an insertion opening 11 at a front end thereof for placing an analog signal plug 4 or a digital signal plug 5, and is enclosed using a rear cover 12*a* or 12*b* at a rear end thereof;
- the analog terminal unit 2 includes a plurality of conductive terminals 21, and each of the of the conductive terminals 21 is inserted into the plastic housing; and suspension arms 21*a* and 21*b* having switch and ground effects, located within an aperture of the insertion opening 11, and being in contact and conducted with an insertion pole of the inserted plug 4 or 5; and
- the digital receiver 3 is disposed at a rear end of the insertion opening 11 of the plastic housing 1, and a reception portion thereof corresponds to a center of the insertion opening 11.

In accordance with the embodiment shown in FIGS. 1 to 4, the analog terminal unit 2 shown has 5 conductive terminals, of which a middle terminal serves as a ground terminal, whereas the rest of the conductive terminals 21 are located on two sides and form two sets of signal switches for providing a wider range of selectivity and better practicability with respect to circuit or control designs thereof.

In accordance with the embodiment shown in FIGS. 1 to 4, the digital receiver 3 is placed into a rear cover 12*b* having an accommodating recess 121, and is enclosed and fastened using a cover plate 122 in a downward direction.

Figure 3:
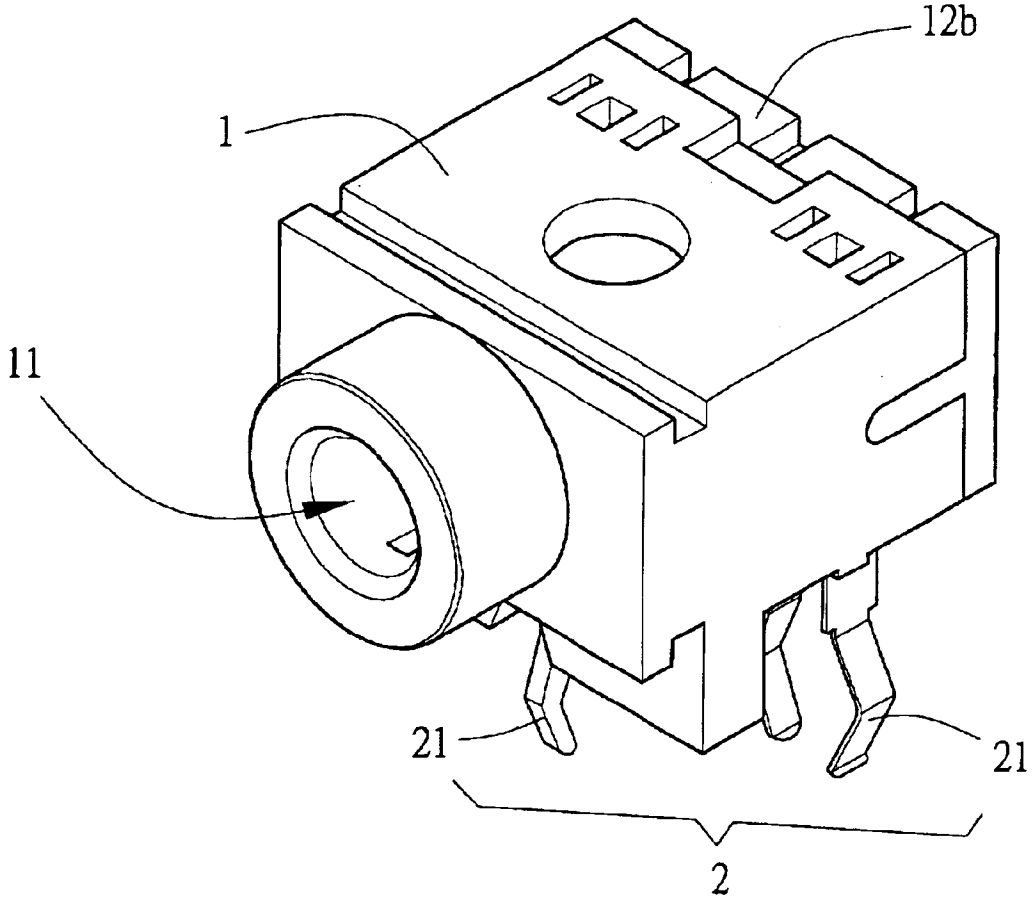
FIG. 3 shows an elevational view illustrating an embodiment according to the invention being implemented as an analog connector.
Figure 4:
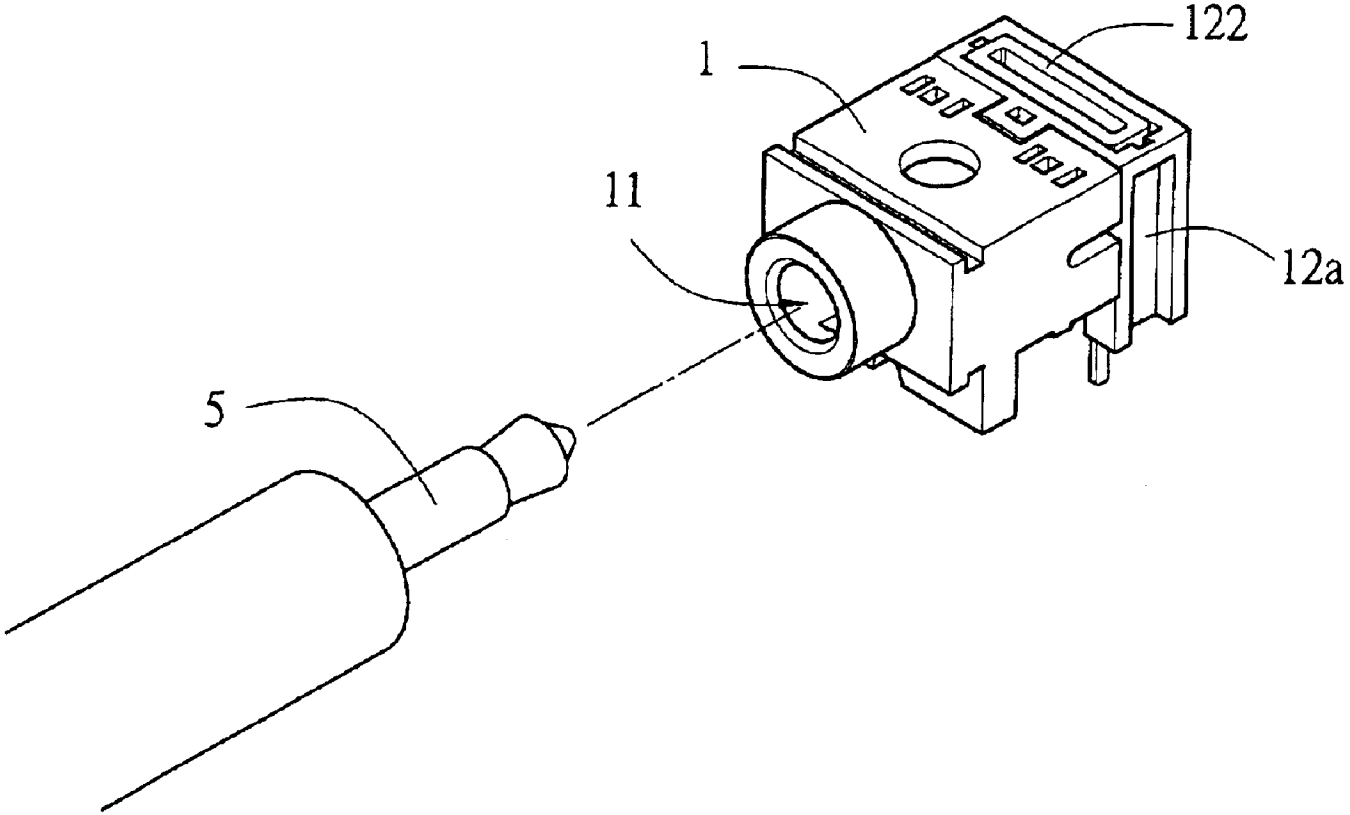
FIG. 4 shows an elevational view illustrating an embodiment according to the invention being implemented as a digital connector.

During assembly according to the aforesaid structure, to obtain a socket structure as an analog signal connector, industrialists may dispose the analog terminal unit 2 in the plastic housing 1, and simply enclose and fasten the structure using the rear cover 12*b* as shown in FIG. 3. Or, to obtain a socket structure as a digital signal connector, the analog terminal unit 2 may be excluded and the plastic housing 1 may be directly joined to the rear cover 12*a* disposed with the digital receiver 3 as shown in FIG. 4. Or optionally, to obtain a socket structure as an analog and digital signal connector, the plastic housing 1 may be simultaneously disposed with the analog terminal unit 2 and the digital receiver 3 as shown in FIG. 1.

For sound equipment that adopts analog signal transmission, the analog signal plug 4 is inserted into the audio connector at least having the analog terminal unit 2 through the insertion opening 11 at the front end of the plastic housing 1, such that the analog terminal unit 2 in the plastic housing 1 comes into contact and conduct with the analog signal plug 4 to further transmit analog signals. For sound equipment that adopts digital signal transmission, the digital signal plug 5 is likewise inserted into the audio connector at least having the digital receiver 3 through the insertion opening 11 at the front end of the plastic housing 1, such that the digital receiver 3 located at the rear of the insertion opening 11 at the plastic housing 1 corresponds with the digital signal plug 5 to further transmit digital signals that use optical signals. Based upon industrialists' requirements, manufacturers may readily prepare or replace with appropriate members in the invention to make various adaptations. For example, modifications or changes in related members such as circuit boards are not even required, and thus lowering production cost and elevating practicability and economical values of the invention.

Figure 5B:
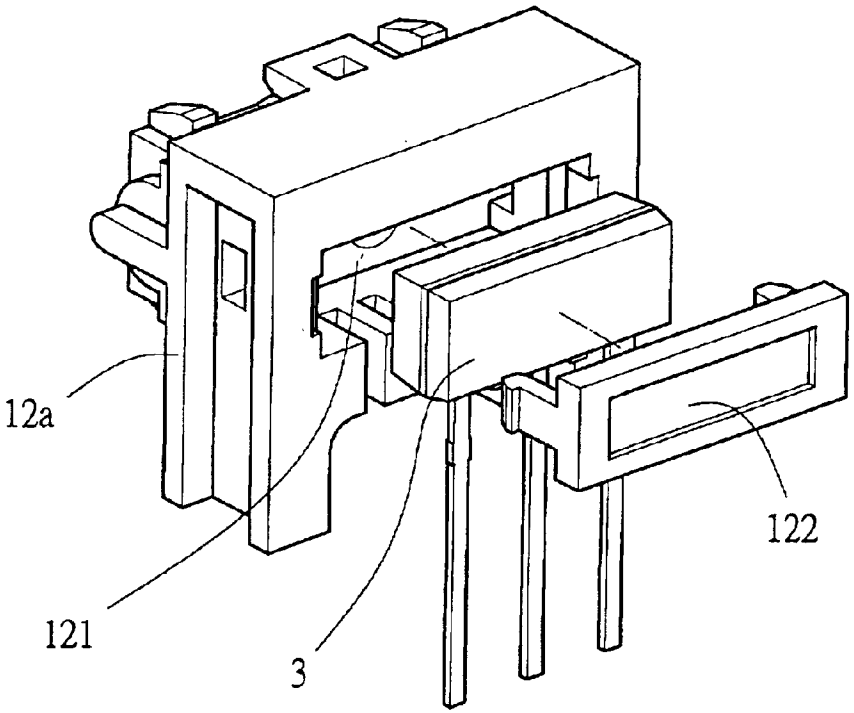
FIGS. 5A and 5B show structural schematic views illustrating two other digital connectors in an embodiment according to the invention.
Figure 5A:
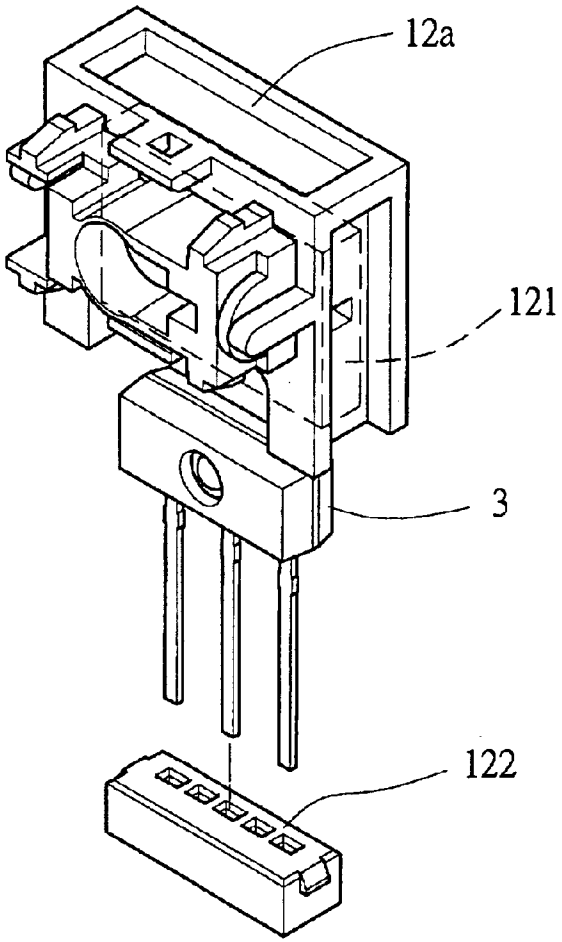

In addition, the aforesaid digital receiver 3 disposed at the rear end of the plastic housing 1 is for receiving signals and functions as an input end. If it is desired to have the digital receiver 3 function as an output end for transmitting signals, the digital receiver 3 may be replaced by a digital transmitter. Furthermore, the assembly and structure of the digital receiver (or transmitter) 3 may also be modified to a structure in an embodiment shown in FIGS. 5A and 5B. Wherein, an opening of the accommodating recess 121 may be provided at a bottom surface of the rear cover 12*a* as shown in FIG. 5A, or at a rear surface of the rear cover 12*a* as shown FIG. 5B. After placing in the digital receiver (or transmitter), a corresponding cover plate 122 is applied for combining into one unit for easily storage and subsequent utilization.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An analog and digital audio connector comprising:

a plastic housing having an insertion opening at an front end thereof for receiving either of an analog signal plug and a digital signal plug, said plastic housing having a rear cover at a rear end thereof;

an analog terminal unit having a plurality of conductive terminals, each of the conductive terminals being inserted into the plastic housing, said analog terminal unit including suspension arms located within an aperture of the insertion opening for contacting an insertion pole of one of the analog signal plug and the digital signal plug;

the rear cover including an accommodating recess, an opening of the accommodating recess receiving a cover plate for sealing and fastening one of a digital receiveing and a digital transmitter placed in the opening of the accommodating recess while also positioning a reception portion of one of the digital receiver and the digital transmitter at a center of the insertion opening.

2. The analog and digital audio connector in accordance with claim 1, wherein the analog terminal unit further comprising five conductive terminals, a middle terminal of the five conductive terminals is a ground terminal whereas the other conductive terminals of the five conductive terminals are located at two sides of the middle terminal and forming two sets of signal switches.

* * * * *